US011215385B2

(12) United States Patent
Longsworth

(10) Patent No.: US 11,215,385 B2
(45) Date of Patent: Jan. 4, 2022

(54) HYBRID GIFFORD-MCMAHON-BRAYTON EXPANDER

(71) Applicant: Sumitomo (SHI) Cryogenics of America, Inc., Allentown, PA (US)

(72) Inventor: Ralph C. Longsworth, Allentown, PA (US)

(73) Assignee: SUMITOMO (SHI) CRYOGENIC OF AMERICA, INC., Allentown, PA (US)

( * ) Notice: Subject to any disclaimer, the term of this patent is extended or adjusted under 35 U.S.C. 154(b) by 276 days.

(21) Appl. No.: 15/009,051

(22) Filed: Jan. 28, 2016

(65) Prior Publication Data

US 2016/0216010 A1 Jul. 28, 2016

Related U.S. Application Data

(60) Provisional application No. 62/108,656, filed on Jan. 28, 2015.

(51) Int. Cl.
*F25B 9/14* (2006.01)
*F25B 9/10* (2006.01)

(52) U.S. Cl.
CPC . *F25B 9/10* (2013.01); *F25B 9/14* (2013.01)

(58) Field of Classification Search
CPC ..... F25B 9/14; F25B 9/145
USPC ..... 62/6
See application file for complete search history.

(56) References Cited

U.S. PATENT DOCUMENTS

| | | | | |
|---|---|---|---|---|
| 3,045,436 | A | 7/1962 | Gifford et al. | |
| 3,609,982 | A * | 10/1971 | O'Neil et al. | F25B 9/14 62/6 |
| 3,613,385 | A * | 10/1971 | Hogan et al. | F25B 9/14 62/6 |
| 3,802,211 | A * | 4/1974 | Bamberg | F25B 9/14 62/6 |
| 3,902,328 | A | 9/1975 | Claudet | |
| 6,256,997 | B1 | 7/2001 | Longsworth | |
| 8,776,534 | B2 | 7/2014 | Dunn et al. | |
| 2007/0253854 | A1 | 11/2007 | Dunn | |
| 2011/0219810 | A1 * | 9/2011 | Longsworth | F25B 9/06 62/474 |

* cited by examiner

*Primary Examiner* — John F Pettitt, III
(74) *Attorney, Agent, or Firm* — Katten Muchin Rosenman LLP

(57) ABSTRACT

A hybrid expander for producing refrigeration at a cryogenic temperature includes a Brayton expander producing refrigeration at a first temperature; a GM expander producing refrigeration at a second temperature, the first temperature being colder than the second temperature, the second temperature being 200K or less. A high pressure line receives a gas from a compressor at a first pressure and supplies it at the first pressure to the Brayton expander and the GM expander simultaneously. A low pressure line returns the gas to the compressor at a second pressure from the Brayton expander and the GM expander, the first pressure being greater than the second pressure. The Brayton expander piston is attached to the cold end of the GM expander displacer and the Brayton expander piston and the GM expander displacer reciprocating together.

11 Claims, 2 Drawing Sheets

HYBRID GIFFORD-MCMAHON-BRAYTON EXPANDER

BACKGROUND OF THE INVENTION

1. Field of the Invention

This invention relates to a refrigerator for producing refrigeration at cryogenic temperatures by combining a GM cycle expander with a Brayton cycle expander for the coldest stage. The GM expander can remove heat exchanger losses in the Brayton heat exchanger and make more cooling available at the colder temperature of the Brayton expander. The gas circulating through the Brayton expander can be used to transport refrigeration to one or more remote heat exchangers. It can be used for example to cool a superconducting magnet at 30 K and a surrounding shield at 70 K.

2. Discussion of the Related Art

A refrigeration system that operates on the Brayton cycle consists of a compressor that supplies gas at a discharge pressure to a counterflow heat exchanger, which admits gas to an expansion space through a cold inlet valve, expands the gas adiabatically, exhausts the expanded gas (which is colder) through a cold outlet valve, circulates the cold gas through a load being cooled, then returns the gas through the counterflow heat exchanger to the compressor at a return pressure. U.S. Pat. No. 3,045,436, by W. E. Gifford and H. O. McMahon describes the GM cycle. This refrigerator system also consists of a compressor that supplies gas at a discharge pressure to an expander which admits gas through a warm inlet valve to the warm end of a regenerator heat exchanger and then into an expansion space at the cold end of a piston from whence it returns back through the regenerator and a warm outlet valve to the compressor at a return pressure. The typical GM type expander being built today has the regenerator located inside the piston so the piston/regenerator becomes a displacer that moves from the cold end to the warm end with the gas at high pressure then from the warm end to the cold end with the gas at low pressure. Since the pressure above and below the displacer is nearly the same, the force from a drive stem required to cause the displacer to reciprocate is small, and can be provided by either a mechanical or pneumatic mechanism. An important difference between GM and Brayton type refrigerators is that Brayton cycle refrigerators can distribute cold gas to a remote load while the cold expanded gas in a GM expander is contained within the expansion space.

Published patent application US 2011/0219810 dated Sep. 15, 2011 by R. C. Longsworth describes a reciprocating expansion engine operating on a Brayton cycle in which the piston has a drive stem at the warm end that is driven by a mechanical drive, or gas pressure that alternates between high and low pressures, and the pressure at the warm end of the piston in the area around the drive stem is essentially the same as the pressure at the cold end of the piston while the piston is moving. U.S. Pat. No. 8,776,534 issued Jul. 15, 2014 to S. Dunn, et al., describes alternate means of actuating the expander piston. A compressor system that can be used to supply gas to either a GM cycle expander or a Brayton cycle engine is described in published patent application U.S. 2007/0253854 titled "Compressor With Oil Bypass" by S. Dunn.

Attaching a piston to a GM displacer results in a small mismatch of pressures between the cold end of the Brayton piston and the warm end of the GM displacer. The extra load on the drive stem due to this pressure difference can be minimized by the timing relationship between the warm valves that control flow to and from the GM displacer and the cold valves that control the flow to and from the Brayton piston.

It is thus an object of the present invention to combine the advantage of the Brayton engine to circulate gas to remote heat stations with the more compact construction of a GM expander. It is also an object to provide cooling at two or more temperatures and increasing the refrigeration available at the coldest stage temperature by intercepting heat leak from room temperature at one or more intermediate temperatures.

SUMMARY OF THE INVENTION

The present invention combines one or more stages of GM cycle cooling with a Brayton cycle cold stage and which uses the flow from the Brayton cold stage to cool a load at a remote heat station. Such a hybrid expander operates with a compressed gas supplied into the hybrid expander at high pressure and discharged from the hybrid expander at a lower pressure.

A GM cycle expander is characterized by a displacer reciprocating in a cylinder which creates a warm displaced volume and one or more GM cold displaced volumes which are connected by one or more regenerators. High pressure gas flows into the warm displaced volume through a warm inlet valve and out of the warm displaced volume through a warm outlet valve, the warm valves opening and closing in sequence. A seal on the displacer prevents gas from by-passing the regenerator.

A Brayton cycle expander is characterized by a piston reciprocating in a cylinder which creates a Brayton cold displaced volume. Gas flows in sequence through a supply line at high pressure, a counterflow heat exchanger, a cold inlet valve to a cold Brayton displaced volume, a cold outlet valve, then returns to the compressor through a heat exchanger that cools a load, the counterflow heat exchanger, and a return line at lower pressure. A seal on the piston prevents gas from by-passing the heat exchanger.

The Brayton expander piston is attached to the cold end of the GM expander displacer and they reciprocate together driven by one of a mechanical drive and a pneumatic drive. The warm GM inlet valve and the cold Brayton inlet valve open at the same time, the warm GM inlet valve closes either before or at the same time as the cold Brayton inlet valve, the warm GM outlet valve and the cold Brayton outlet valve open at the same time, the warm GM outlet valve closes either before or at the same time as the cold Brayton outlet valve.

One or more stages of GM cooling can be used to intercept heat in the Brayton heat exchanger and cool loads either by direct attachment to the GM heat station(s) or at remote heat stations by circulating gas flowing through the Brayton expander.

Definitions

Warm inlet valve—a valve which is used to let a high pressure gas stream enter a warm displaced volume of a GM expander and operating at a temperature above 200 K Warm outlet valve—a valve which is used to let a lower pressure gas stream exit a warm displaced volume of a GM expander and operating at a temperature above 200 K Cold inlet valve—a valve which is used to let a high pressure gas stream enter a cold displaced volume of a Brayton expander and operating at a temperature below 200 K Cold outlet valve—a valve which is used to let a lower pressure gas stream exit a cold displaced volume of a Brayton expander and operating at a temperature below 200 K High pressure line—a line which is used to direct a high pressure gas stream to either of the inlet valves Lower pressure line—a line which is used to direct a lower pressure gas stream out of cold displaced volumes

DETAILED DESCRIPTION OF THE INVENTION

Figure 1:
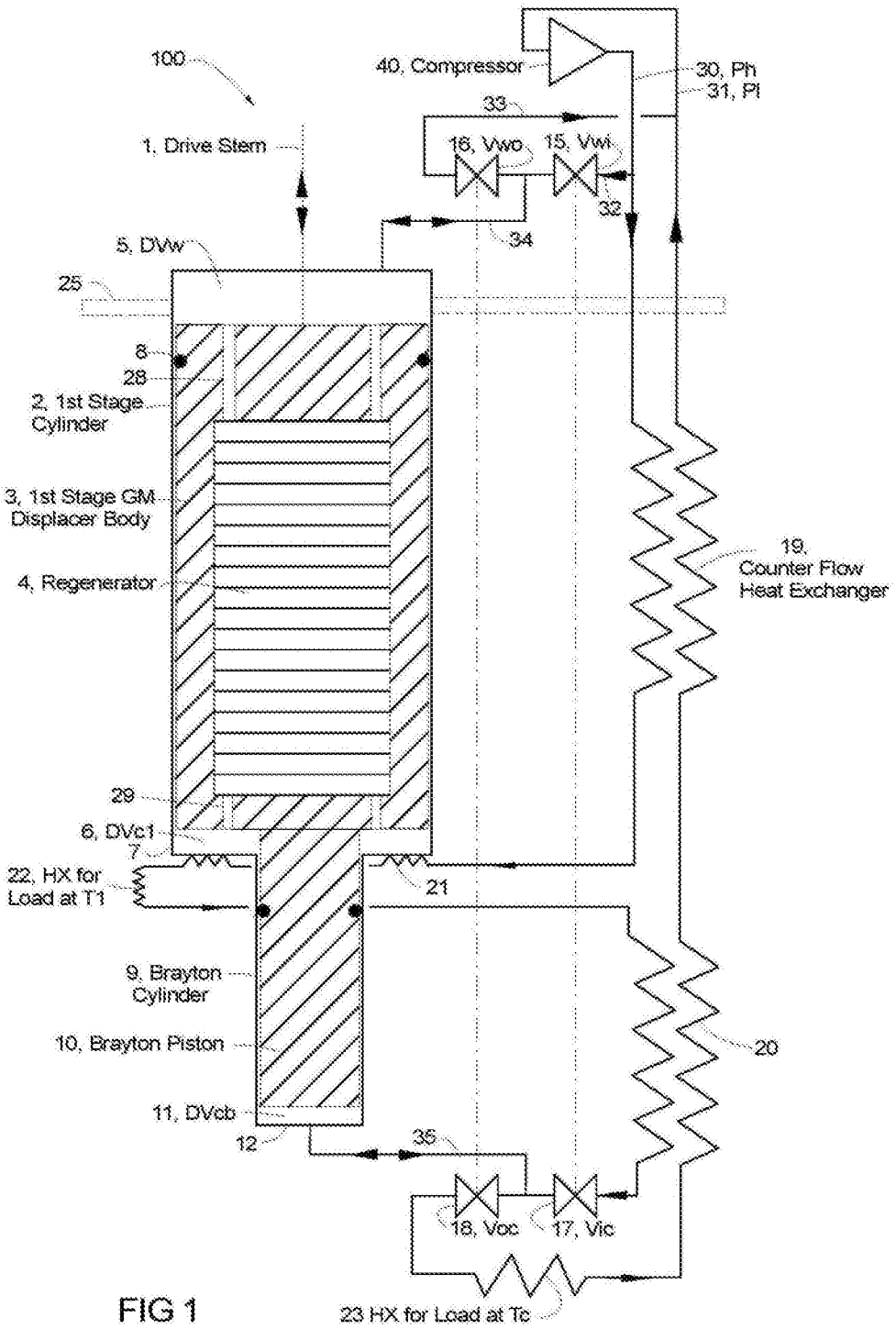
FIG. 1 shows hybrid expander 100 comprising a GM cycle first stage and a Brayton cycle cold stage.

FIG. 1 shows the essential concepts of this invention, i.e. hybrid expander 100, namely a first stage operating on the GM cycle and a cold stage operating on the Brayton cycle. Both GM and Brayton cycle expanders receive gas at high pressure from a compressor, 40 via high pressure line 30, and return the gas to compressor 40 at low pressure via lower pressure line 31. For cryogenic refrigerators the gas is usually helium and the high and low pressures are typically 2.2 MPa and 0.8 MPa but not limited to that. Components situated below warm flange 25 operate in a vacuum while components situated above flange 25 operate in a room temperature environment.

Continuing on FIG. 1, the GM first stage expander comprises; a) displacer body 3 which reciprocates in cylinder 2, thus creating warm displaced volume 5, DVw, and first stage cold displaced volume 6, DVc1, at first stage heat station 7, b) regenerator 4 is shown in displacer body 3 with gas passages 28 that connect it to DVw 5 and gas passages 29 that connect it to DVc16, c) seal 8 on displacer body 3 that forces gas to flow between DVw 5 and DVc1 6 through regenerator 4, d) a drive mechanism to cause displacer body 4 to reciprocate, represented by drive stem 1, e) inlet valve 15 that connects high pressure line 30 to DVw 5 through lines 32 and 34, and f) outlet valve 16 which connects DVw 5 to low pressure line 31 through lines 34 and 33.

The Brayton cold stage expander shown in FIG. 1 comprises; a) piston 10 which is attached to displacer body 3 of the GM expander and reciprocates in cylinder 9 creating cold displaced volume 11, DVcb, at cold stage cold end 12, b) counter flow heat exchangers 19 and 20, c) heat exchanger 23 for cooling of a remote load, d) cold inlet valve 17 that connects high pressure line 30 to DVcb 11 through heat exchangers 19 and 20 and line 35, and e) cold outlet valve 18 which connects DVcb 11 to low pressure line 31 through line 35 and heat exchangers 23, 19 and 20.

Brayton heat exchanger 19 and 20 is split into two sections so that the high pressure gas flowing to DVcb 11 can flow through heat exchanger 21 to be cooled by refrigeration produced in DVc1 6 and can also be used to transport refrigeration to remote heat exchanger 22.

Figure 2A:
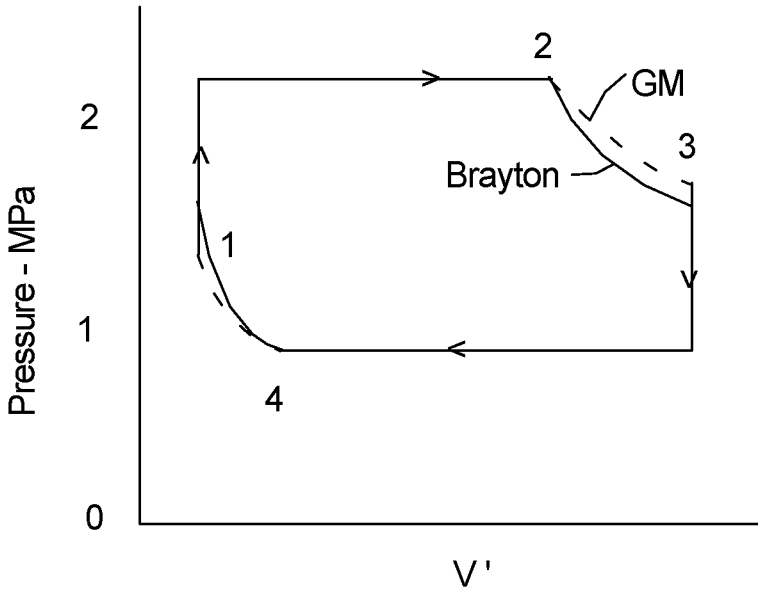
FIG. 2A shows a pressure vs displaced volume, PV, diagram for the case in which the inlet and outlet valves for the GM and Brayton stages open and close at the same time.

A pneumatic drive mechanism that can be used to drive the GM first stage which is shown schematically in FIG. 1 is described in detail in U.S. Pat. No. 6,256,997. FIG. 2A of the '997 patent shows a two stage GM expander to which a Brayton cold stage could be attached. FIG. 2A of the said patent also shows a rotary valve, 26, which functions as inlet valve 15 and outlet valve 16, which are shown in FIG. 1 of the present application.

A mechanical drive mechanism that can be used to drive the GM first stage which is shown schematically in FIG. 1 is described in US. published patent application 2012/0285181 titled "Gas Balanced Cryogenic Expansion Engine". FIG. 2 of the '181 application shows rotary valve 18, 19 which functions as inlet valve 15 and outlet valve 16 shown in FIG. 1 of this application but also contains ports to pneumatically actuate cold poppet valves which are equivalent to cold inlet valve 17 and cold outlet valve 18 shown in FIG. 1 of this application. Rotary valve disc 18 in the '181 application is mounted on the end of the drive shaft that causes piston 1 to reciprocate, thus the timing of opening and closing the warm and cold valve is coordinated with the position of piston 1. The optimization of the timing of the opening and closing of the warm and cold valves can be achieved by the slot pattern in rotary valve disc 18 and the ports in valve seat 9. The mechanism that actuates the warm and cold valves in the '181 application can also be used to actuate the pneumatic drive mechanism of the '997 patent.

It is important to have a mechanism in the present hybrid expander that controls the opening and closing of warm valves 15 and 16 and cold valves 17 and 18 while maintaining their fixed relation with each other and with the position of reciprocating displacer 3 and piston 10 in order to optimize the cooling that is produced and to minimize the force required to drive the reciprocating components. The driving force is minimized by having the pressures in DVw, 5, DVc1, 6, and DVcb, 11, be as close as possible throughout a cycle.

FIG. 2*a* shows the relationship between the pressures in the displaced volumes versus the normalized cold displaced volume for the case when inlet valves 15 and 17, shown in FIG. 1, open at the same time, point 1, and close at the same time, point 2, and outlet valves 16 and 18, shown in FIG. 1, open at the same time, point 3, and close at the same time, point 4. Between points 2 and 3 the pressure in DVw 5 and DVc1 6 does not drop as much as the pressure in DVcb 11 because gas in regenerator 4 flows into DVc1 7 during expansion. There is a similar pressure difference between points 4 and 1. The pressure difference between DVw 5 and DVcb 11 between points 2 and 3 requires more force to drive displacer 3 towards the warm end than to just overcome friction and pressure drop forces. Similarly extra force is required to move displacer 3 toward the cold end between points 4 and 1.

Figure 2B:
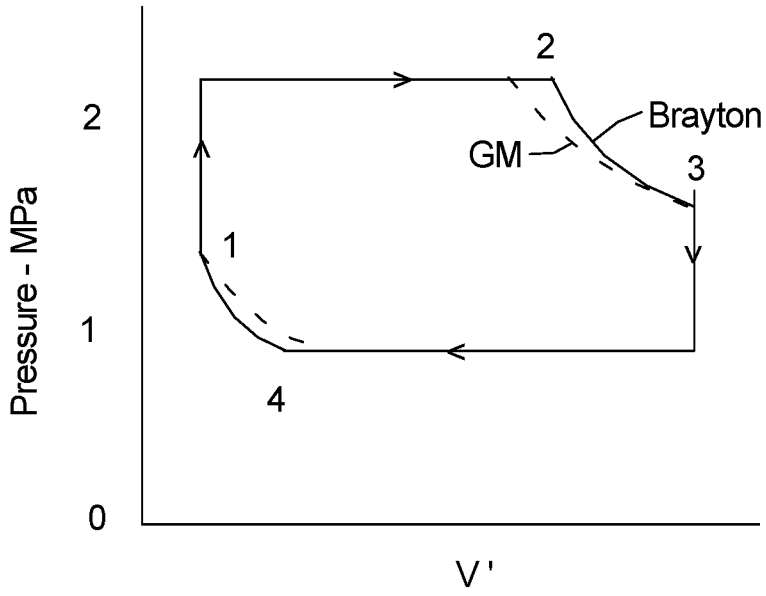
FIG. 2B shows a PV diagram for the case in which the inlet valves for the GM and Brayton stages open at the same time and the inlet and outlet valves for the GM stage close before the inlet and outlet valves for the Brayton stage.

FIG. 2*b* shows the relationship between the pressures in the displaced volumes versus the normalized cold displaced volume for the case when inlet valves 15 and 17, shown in FIG. 1, open at the same time, point 1, but inlet valve 15 closes before inlet valve 17, point 2, and outlet valves 16 and 18, shown in FIG. 1, open at the same time, point 3, but outlet valve 16 closes before outlet valve 18, point 4. Between points 2 and 3 the pressure in DVw 5 and DVc1 6 drops more than the pressure in DVcb 11 because gas in regenerator 4 flows into DVc1 7 during expansion. There is a similar pressure difference between points 4 and 1. The pressure difference between DVw 5 and DVcb 11 between points 2 and 3 can help drive displacer 3 towards the warm end. Similarly the pressure difference between points 4 and 1 can help move displacer 3, shown in FIG. 1, toward the cold end. The optimum timing of closing valves 15 and 16 relative to valves 17 and 18 is to have the pressures in DVc1 6 and DVCb 11 be equal at points 3 and 1. Calculations have been made for the cooling that would be expected for hybrid expander 100 from a compressor that compresses 5 g/s of helium at room temperature from 0.8 MPa to 2.2 MPa and draws about 8 KW of power. A hybrid expander operating at 2.4 Hz, 2.2/0.8 MPa, having a GM displacer with a diameter of 83 mm and a Brayton piston with a diameter of 60 mm would provide about 25 W of cooling at a remote heat exchanger at 100 K and 100 W of cooling at a remote heat exchanger at 30 K. A two stage GM expander with the same first stage diameter and a second stage diameter that results in a first stage capacity of 25 W at 100 K would have a cooling capacity of about 65 W at 30 K.

What is claimed is:

1. A hybrid expander producing refrigeration at cryogenic temperatures, the hybrid expander comprising:

a first stage expander having a warm end and a cold end, wherein the first stage expander comprises:

a first cylinder having a warm displaced volume at the warm end of the first stage expander and a cold displaced volume at the cold end of the first stage expander; and a displacer reciprocating in the first cylinder;

a cold stage expander comprising:

a second cylinder connected to the first cylinder and having a cold displaced volume at a cold end of the cold stage expander, wherein the first cylinder has a larger diameter than the second cylinder, wherein the cold displaced volume of the second cylinder is not connected to directly fluidly communicate with the cold displaced volume of the first cylinder; and a piston reciprocating in the second cylinder between the cold displaced volume of the first cylinder and the cold displaced volume of the second cylinder, wherein the cold end of the cold stage expander produces a refrigeration temperature colder than a refrigeration temperature of the cold end of the first stage expander, and the piston of the cold stage expander is attached to the displacer of the first stage expander;

a drive mechanism for reciprocating the displacer and piston together between the warm displaced volume of the first cylinder and the cold displaced volume of the second cylinder;

a high pressure line for receiving a gas from a compressor at a first pressure and supplying a first portion of the gas at a first pressure through a warm inlet valve to the warm displaced volume of the first stage expander and a second portion of the gas to the cold displaced volume of the cold stage expander through a cold inlet valve connected to the cold displaced volume of the cold stage expander;

a low pressure line for returning the first portion of the gas to the compressor at a second pressure through a warm outlet valve from the warm displaced volume of the first stage expander and the second portion of the gas through a cold outlet valve from the cold displaced volume of the cold stage expander, the first pressure being greater than the second pressure, wherein the first stage expander comprising a regenerator connecting the warm displaced volume of the first stage expander to the cold displaced volume of the first stage expender, wherein a portion of the first portion of the gas flows between the warm displaced volume of the first stage expander and the cold displaced volume of the first stage expander through the regenerator, wherein the warm inlet valve supplies the first portion of the gas into the warm displaced volume, and the warm outlet valve returns the first portion of the gas in the cold displaced volume, the regenerator, and the warm displaced volume of the first stage expander to the low pressure line, wherein the first stage expander has a port formed at the warm end of the first stage expander to admit the first portion of the gas to the warm displaced volume of the first stage expander through the warm inlet valve, and to return the first portion of the gas to the low pressure line from the warm displaced volume of the first stage expander through the warm outlet valve, and wherein the port is in a room temperature environment; and at least one counterflow heat exchanger formed between the high pressure line and the low pressure line, wherein the counterflow heat exchanger transfers heat of the second portion of the gas flowing through the high pressure line to said cold inlet valve to the second portion of the gas flowing through the low pressure line returning to the compressor from the cold stage expander.

2. The hybrid expander in accordance with claim 1, wherein opening and closing of the warm inlet and outlet valves are coordinated with opening and closing of the cold inlet and outlet valves.

3. The hybrid expander in accordance with claim 1, wherein the second portion of the gas at the first pressure is brought into thermal contact with the cold displaced volume of the first stage expander.

4. The hybrid expander in accordance with claim 3, wherein the second portion of the gas at the first pressure that has been brought into the thermal contact with the cold displaced volume of the first stage expander passes through a remote heat exchanger in contact with a load before returning to said counterflow heat exchanger.

5. The hybrid expander in accordance with claim 1, wherein the second portion of the gas at the second pressure, after exiting said cold outlet valve, passes through a remote heat exchanger in contact with a load before returning to said counterflow heat exchanger.

6. The hybrid expander in accordance with claim 1, wherein a valve timing is such that both warm and cold inlet valves open simultaneously, the warm and cold inlet valves close simultaneously, both warm and cold outlet valves open simultaneously, and the warm and cold outlet valves close simultaneously.

7. The hybrid expander in accordance with claim 1, wherein a valve timing is such that both warm and cold inlet valves open at the same time, the warm inlet valve closes before the cold inlet valve, both warm and cold outlet valves open at the same time, and the warm outlet valve closes before the cold outlet valve.

8. The hybrid expander in accordance with claim 1, wherein the warm inlet and outlet valves are disposed closer to the warm displaced volume of the first stage expander than the cold displaced volume of the first stage expander.

9. The hybrid expander in accordance with claim 1, further comprising a heat exchanger disposed on the cold displaced volume of the first stage expander to cool the second portion of the gas.

10. The hybrid expander in accordance with claim 1, wherein the warm inlet valve and the warm outlet valve are at room temperature.

11. The hybrid expander in accordance with claim 1, wherein the cold stage expander has a port at the cold end of the cold stage expander to admit the second portion of the gas to the cold displaced volume of the cold stage expander through the cold inlet valve, and to return the second portion of the gas to the low pressure line from the cold displaced volume of the cold stage expander through the cold outlet valve.

* * * * *